US005890045A

United States Patent [19]

Till et al.

[11] Patent Number: 5,890,045

[45] Date of Patent: Mar. 30, 1999

[54] ELASTIC INTERMEDIATE BELT AND SYSTEM PARTICULARLY FOR USE IN ELECTROSTATOGRAPHIC PRINTING SYSTEMS

[75] Inventors: Henry R. Till, East Rochester; Vittorio R. Castelli, Yorktown Heights, both of N.Y.

[73] Assignee: Xerox Corporation, Stamford, Conn.

[21] Appl. No.: 4,291

[22] Filed: Jan. 8, 1998

[51] Int. Cl.[6] ..... G03G 15/16

[52] U.S. Cl. ..... 399/308; 399/297; 399/302

[58] Field of Search ..... 399/297, 302, 399/308, 66; 430/126

[56] References Cited

U.S. PATENT DOCUMENTS

| | | | |
|---|---|---|---|
| 4,684,238 | 8/1987 | Till et al. . | |
| 5,099,286 | 3/1992 | Nishise et al. . | |
| 5,510,886 | 4/1996 | Sugimoto et al. | 399/308 |
| 5,521,037 | 5/1996 | Nagase et al. | 430/126 |
| 5,761,594 | 6/1998 | Seto et al. | 399/302 |

FOREIGN PATENT DOCUMENTS

| | | |
|---|---|---|
| 6-011977 | 1/1994 | Japan . |
| 6-308840 | 11/1994 | Japan . |
| 8-160774 | 6/1996 | Japan . |

*Primary Examiner*—Matthew S. Smith

[57] ABSTRACT

A printing system including a moving intermediate transfer member for transporting a developed image from a moving image bearing member to a moving copy substrate. The moving intermediate member includes an elastic belt adapted to receive the developed image from the moving image bearing member at a first nip formed between the moving image bearing member and the moving intermediate member, and further adapted to transfer the developed image from the moving intermediate member to the moving copy substrate at a second nip formed between the moving intermediate member and the moving copy substrate, wherein the moving image bearing member and the moving intermediate member are transported at a substantiality equivalent first velocity in the first nip and a second velocity, substantially different from the first velocity, in the second nip. The combination of an elastic belt and differential velocities permits for the selective compression and stretching of the intermediate transfer member along a path of travel thereof.

14 Claims, 2 Drawing Sheets

Figure 1:
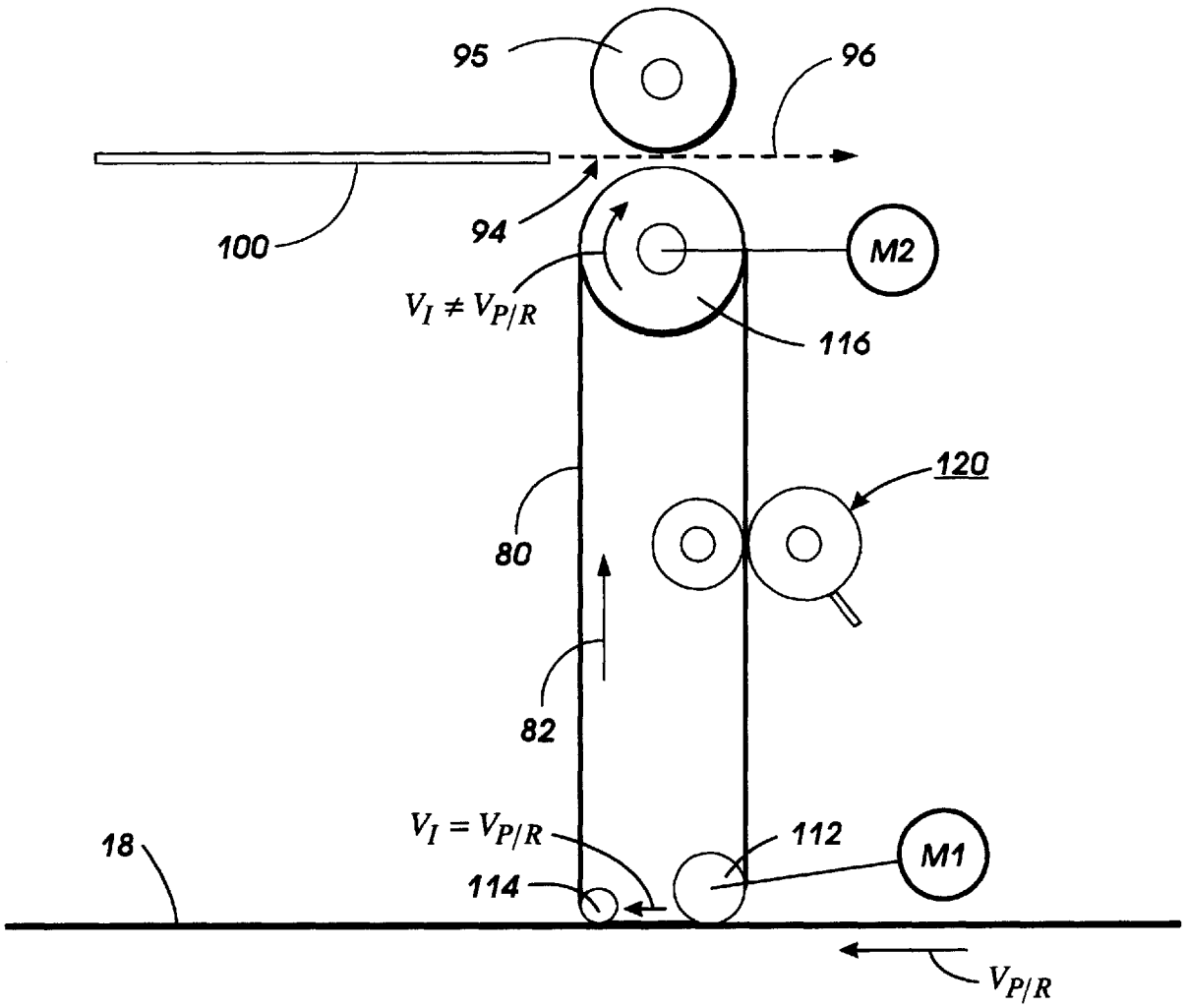

ELASTIC INTERMEDIATE BELT AND SYSTEM PARTICULARLY FOR USE IN ELECTROSTATOGRAPHIC PRINTING SYSTEMS

This invention relates generally to an intermediate transfer member for use in copying and printing systems, and, more particularly, concerns an elastic intermediate transfer belt and system for particular use in a multi-color electrostatographic printing machine.

Generally, the process of electrostatographic copying is initiated by exposing a light image of an original document to a substantially uniformly charged photoreceptive member. Exposing the charged photoreceptive member to light in an imagewise configuration selectivity discharges the photoconductive surface thereof in an imagewise manner corresponding to image and non-image areas in the original input document, resulting in the creation of a latent electrostatic image on the photoreceptive member. The latent image is subsequently developed into a visible image by a process in which charged developing material is deposited onto the surface of the photoreceptive member. Typically, this developing material comprises carrier granules having toner particles adhering triboelectrically thereto, wherein the toner particles are electrostatically attracted from the carrier granules to the latent image for forming a developed powder image on the photoreceptive member. Alternatively, liquid developing materials comprising a liquid carrier material having toner particles dispersed therein have been successfully utilized, wherein the liquid developing material is applied to the latent image with the toner particles being attracted toward the image areas via electrophoresis to form a developed image. Regardless of the type of developing material employed, the toner particles making up the developed image are subsequently transferred from the photoreceptive member to a copy substrate, either directly or by way of an intermediate transfer member. Thereafter, the image may be permanently affixed to the copy substrate to produce a "hard copy" reproduction or print of the original document or file. A final process step typically involves cleaning the photoreceptive member to remove any residual charge and/or developing material from the photoconductive surface in preparation for subsequent imaging cycles.

The above described electrostatographic imaging process is well known and is useful for light lens copying from an original input document as well as for printing applications involving electronically generated or stored data representing the desired output image. Analogous processes also exist in other printing applications such as, for example, ionographic printing and reproduction where charge is deposited directly onto a charge retentive surface in an imagewise manner.

The electrostatographic printing process described above exemplifies a basic process for producing monocolor output images. This process can be modified to produce multicolor images. For example, a so-called subtractive color mixing process can be utilized to create so-called process multicolor images by overlaying color separated images of three colors, namely cyan, magenta and yellow.

One exemplary method for producing process multicolor images is described as the Recharge, Expose, and Development (REaD) image-on-image process, wherein different color toner layers are deposited in superimposed registration with one another on a photoconductive surface or other recording medium to create a multilayered, multicolored, toner image thereon. In this process, the recording medium is initially exposed to record a latent image thereon corresponding to a first subtractive color. This image is then developed with appropriately colored developing material at a first development station. Thereafter, the recording medium, having the developed image thereon, is recharged and re-exposed to record a latent image corresponding to another subtractive primary color superimposed on the previous image. This image is again developed with appropriately colored developing material and the process is repeated until all the different color toner layers are deposited in superimposed registration with one another to form a multilayer, multicolor image. The multilayer toner image is then transferred, either directly or indirectly, to a copy substrate. In the case of indirect transfer, an intermediate transfer member in the form of a belt or drum is typically used to facilitate further processing of the multilayer image on a surface other than the photoconductive substrate prior to transfer to the copy substrate. Variations on this general technique for forming multicolor images are well known in the art and may make advantageous use of the present invention.

As previously noted, it is known in the art to transfer a developed image to an intermediate transfer member prior to transfer of the image to a final support substrate. The use of an intermediate transfer member is particularly advantageous in producing multicolor output prints via the various processes known and associated with electrostatic printing processes. Intermediate transfer members can enable higher output copy speeds in certain multicolor applications and can also provide improved registration for producing the final output multicolor image. In addition, with particular respect to liquid developing material based electrostatographic imaging systems, intermediate transfer members permit the application of certain image conditioning techniques useful in reducing the amount of liquid in the image or otherwise preparing the liquid image for transfer to a copy sheet. Various examples of intermediate transfer members can be found in U.S. Pat. Nos. 5,537,194; 5,521,037; 5,119,140; 5,110,702; and 5,099,286, among numerous other patents and technical literature.

The present invention is directed toward an elastic intermediate transfer member which can enable the use of differential velocities between a first transfer nip formed at the interface between the photoreceptor and the intermediate transfer member, and a second transfer nip formed at the interface between the intermediate transfer member and the copy substrate. The use of differential velocities as prescribed above yields various benefits, including: intermediate belt seam position control; improved copy substrate stripping; use of broader range of copy substrates; isolation of motion quality noise; greater resiliency with respect to handling and environmental conditions; and permitting the use of thinner copy substrates having a relatively low dielectric thickness and thermal mass.

The following disclosures may be relevant to some aspects of the present invention:

U.S. Pat. No. 4,684,238

Patentee: Till et al.

Issued: Aug. 4, 1987

U.S. Pat. No. 5,099,286

Patentee: Nishese et al.

Issued: Mar. 24, 1992

U.S. Pat. No. 5,521,037

Patentee: Nagase et al.

Issued: May 28, 1996

The relevant portions of the foregoing patents may be briefly summarized as follows:

U.S. Pat. No. 4,684,238 discloses an apparatus in which a plurality of liquid images are transferred from a photoconductive member to a copy sheet. The liquid images, which include a liquid carrier having toner particles dispersed therein, are attracted from the photoconductive member to an intermediate belt. Liquid carrier is removed from the intermediate belt and the toner particles are compacted thereon in image configuration. Thereafter, the toner particles are transferred from the intermediate belt to the copy sheet in image configuration.

U.S. Pat. No. 5,099,286 discloses an image forming apparatus comprising a toner image retaining member having an electrically conductive substrate and a dielectric layer formed thereon. In the image forming apparatus, an electrostatic latent image corresponding to an image of a document is formed on a photoconductive member, and the electrostatic latent image is developed with a toner so as to form a visible toner image on the photoconductive member. Thereafter, the dielectric layer is electrified and is brought into contact with the photoconductive member so as to transfer the toner image onto the toner image retaining member in an initial transfer process. The transferred toner image is subsequently transferred onto a paper in a secondary transfer process.

U.S. Pat. No. 5,521,037 discloses an intermediate transfer material and an image forming method using the intermediate transfer member in a liquid developing material based electrostatographic printing apparatus, wherein a developed liquid image is transferred to the intermediate transfer member and subsequently retransferred from the intermediate to a final support substrate. The intermediate transfer member includes at least a silicone rubber layer, an adhesive layer, and a conductive fluorine rubber substrate. That patent indicates that the intermediate transfer material provides excellent durability and transferability, for producing high quality images at high reproducibility.

In accordance with one aspect of the present invention, there is provided a printing system including an apparatus for transporting a developed image from a moving image bearing member to a moving copy substrate, comprising a moving intermediate member including an elastic belt adapted to receive the developed image from the moving image bearing member at a first nip formed between the moving image bearing member and the moving intermediate member, and further adapted to transfer the developed image from the moving intermediate member to the moving copy substrate at a second nip formed between the moving intermediate member and the moving copy substrate.

In accordance with another aspect of the present invention, an apparatus for transporting a layer of material from a first moving member to a second moving member, comprising a moving intermediate member including an elastic belt adapted to receive the layer of material from the first moving member at a first nip formed between the first moving member and the moving intermediate member, and further adapted to transfer the layer of material from the moving intermediate member to the second moving member at a second nip formed between the moving intermediate member and the second moving member.

In accordance with yet another aspect of the present invention, a method for transporting a developed image from a moving image bearing member to a moving copy substrate, comprising the steps of transferring the developed image from the moving image bearing member to a moving intermediate transfer member including an elastic belt at a first nip formed between the moving image bearing member and the moving intermediate member; transferring the developed image from the moving intermediate transfer member to the copy substrate at a second nip formed between the moving intermediate member and the moving copy substrate; transporting the moving image bearing member and the moving intermediate member at a substantiality equivalent first velocity in the first nip; and transporting the intermediate member and the moving copy substrate at a substantiality equivalent second velocity different from the first velocity in the second nip.

Figure 2:
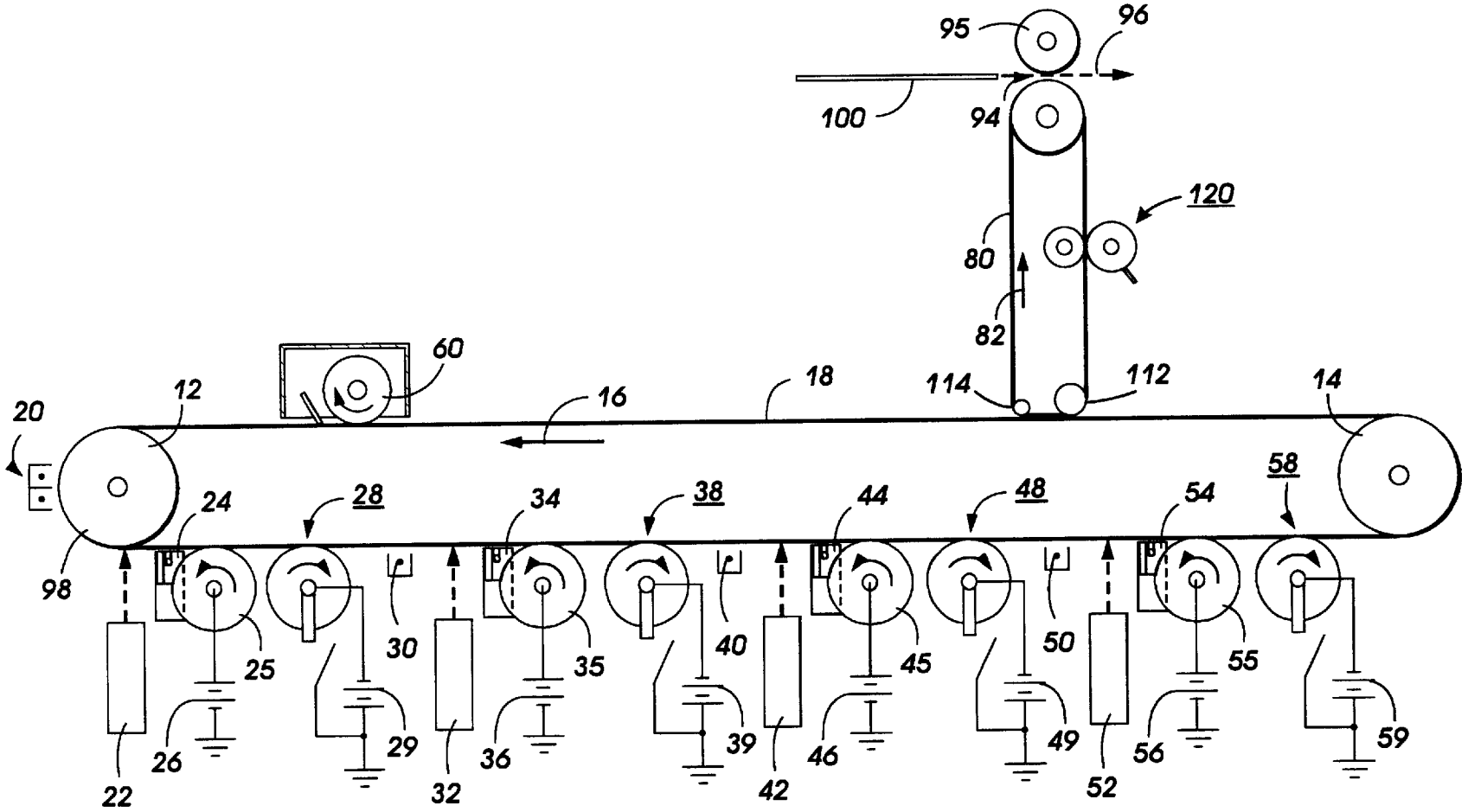

Other aspects of the present invention will become apparent as the following description proceeds and upon reference to the drawings, in which:

FIG. 1 is a schematic elevational view of the intermediate transfer member of the present invention, illustrating the differential velocities enabled by the use of an elastic intermediate transfer belt in accordance with the present invention; and FIG. 2 is a schematic, elevational view of an exemplary multicolor liquid developing material based electrostatographic printing machine incorporating an elastic intermediate transfer member in accordance with the present invention.

For a general understanding of the features of the present invention, reference is made to the drawings, wherein like reference numerals have been used throughout to designate identical elements. FIG. 2 is a schematic elevational view illustrating an exemplary multicolor electrostatographic printing machine incorporating the features of the present invention. Inasmuch as the art of electrostatographic printing is well known, the various processing stations employed in the printing machine of FIG. 2 will be described briefly prior to describing the invention in detail. It will become apparent from the following discussion that the apparatus of the present invention may be equally well-suited for use in a wide variety of printing machines and is not necessarily limited in its application to the particular electrostatographic machine described with respect to FIG. 2. Thus, while the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 2, the multicolor electrostatographic printing machine shown employs a photoreceptive belt 18 which comprises a multilayered structure, including a photoconductive surface deposited on an electrically grounded conductive substrate. The photoreceptive belt 18 is transported along a curvilinear path defined by rollers 12 and 14 for advancing successive portions of the photoreceptive belt 18 sequentially through the various processing stations disposed about the path of movement thereof, in the direction of arrow 16.

Initially, the belt 18 passes through a charging station where a corona generating device 20 charges the photoconductive surface of belt 18 to relatively high, substantially uniform electrical potential.

After the substantially uniform charge is placed on the photoreceptive surface of the belt 18, the printing process proceeds by an imaging step adapted for discharging the photoconductive surface in accordance with the image to be generated. For multicolor printing and copying, the imaging process typically involves the separation of imaging information into individual color components for providing a series of subtractive imaging signals, with each subtractive imaging signal being proportional to the intensity of the incident light of each of the primary color components. These imaging signals are then transmitted to a series of individual raster output scanners (ROSs) 22, 32, 42 and 52 for generating complementary, color separated, latent images on the charged photoreceptive belt 18. Each ROS 22, 32, 42 and 52 typically writes the latent image information on to the photoreceptor in a pixel by pixel manner, as known in the art of electrophotography.

The present description is directed toward a Recharge, Expose, and Develop (REaD) process, wherein the charged photoconductive surface of photoreceptive member 18 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD), wherein charged areas are developed can be employed, as will be described. It will be recognized that this REaD process represents only one of various multicolor processing techniques that may be used in conjunction with the present invention.

In the exemplary electrostatographic system of FIG. 2, each of the color separated electrostatic latent images are serially developed on the photoreceptive belt 18 using a liquid developing material via a fountain-type developing apparatus 24, 34, 44 and 54, which may be of the type disclosed in U.S. Pat. No. 5,579,473. As noted hereinabove, the use of liquid developing materials in electrostatographic imaging processes is well known. Indeed, various types of liquid developing materials and development systems have been disclosed for use in electrostatographic printing applications. Liquid developing materials have many advantages, and typically produce images of higher quality than images formed with dry toners. Most notably, since liquid developing materials are comprised of marking particles immersed in a liquid carrier, the marking particles can be made to be very small without the resultant problems typically associated with small particle powder toners such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height, among other factors. Notwithstanding the many advantages of liquid developing materials, it will be understood that the present invention is not limited to liquid developing materials and may be practiced with dry developing materials.

Appropriately colored developing material is transported into contact with the surface of belt 18. By way of example, developer apparatus 24 transports cyan colored liquid developing material, developer apparatus 34 transports magenta colored liquid developing material, developer apparatus 44 transports yellow colored liquid developing material, and developer apparatus 54 transports black colored liquid developing material. Each different color developing material is comprised of charged toner particles disseminated through the liquid carrier, wherein the toner particles are attracted to the latent image areas on the surface of belt 18 by electrophoresis for producing a visible developed image thereon.

Each developer station may also include a metering roll 25, 35, 45, 55 situated adjacent to a corresponding developer fountain 24, 34, 44 and 54 and in close proximity to the surface of photoreceptive belt 18. The metering roll generally rotates in a direction opposite the movement of the photoconductor surface so as to exert a shear force on the liquid developed image in the area of the nip formed between the surface of the photoreceptor and the metering roll. This shear force removes an initial amount of the liquid developing material from the surface of the photoreceptor for minimizing the thickness of the developing material thereon. The excess developing material removed by the metering roll eventually falls away from the rotating metering roll for collection in a sump, not shown. A DC power supply 26, 36, 46, 56 may also be provided for maintaining an electrical bias on the metering roll at a selected polarity for enhancing image development. Each of the developer stations shown in FIG. 2 are substantially identical to one another and represent only one of various known apparatus or systems that can be utilized to apply liquid developing material to the photoconductive surface or other image recording medium.

After image development, the liquid developed image on the photoconductor 18 may be further processed or "conditioned" to compress the image and remove amounts of the liquid carrier therefrom, as shown, for example, by U.S. Pat. No. 4,286,039 or 5,493,369, among various other patents. The image conditioning process typically increases the solids percentage of the image. An exemplary apparatus for image conditioning is shown at reference numerals 28, 38, 48 and 58, each comprising a roller which may preferably include a porous body and a perforated skin covering. The image conditioning rolls 28, 38, 48 and 58 are typically biased to a potential having a polarity which inhibits the departure of toner particles from the image on the photoreceptor 18, while compacting the toner particles of the image onto the surface thereof. In an exemplary image conditioning system of U.S. Pat. No. 5,493,369, a vacuum source (not shown) may also be provided, coupled to the interior of the roller, for creating an airflow through the porous roller body to draw liquid from the surface of the photoreceptor, thereby increasing the percentage of toner solids in the developed image.

In the presently described illustrative multicolor printing process, after image conditioning of the first developed image, the imaging and development steps are repeated for subsequent color separations by recharging and reexposing the belt 18, whereby color image information is superimposed over the previous developed image. For each subsequent exposure an adaptive exposure processing system may be employed for modulating the exposure level of the raster output scanner (ROS) 32, 42 or 52 for a given pixel as a function of the developing material previously developed at the pixel site, thereby allowing toner layers to be made independent of each other, as described in U.S. Pat. No. 5,477,317. The reexposed image is next advanced through a corresponding development station and subsequently through an associated image conditioning station, for processing in the manner previously described. Each step is repeated as previously described to create a multilayer image made up of black, yellow, magenta, and cyan toner particles as provided via each developing station. It should be evident to one skilled in the art that the color of toner at each development station could be provided in a different arrangement.

After the multilayer image is created on the photoreceptive member 18, it is advanced to an intermediate transfer station for transferring the image from the photoconductive belt 18 to an intermediate transfer member, identified by reference numeral 80, for subsequent transfer to a copy substrate 100. A charging device, or other electrostatic transfer device (not shown), may be provided for assisting image transfer to the intermediate member 80. The intermediate transfer member moves in the direction of arrow 82 for transporting transferred images to a transfer nip 94, where the developed image is again transferred and affixed to a recording sheet 100 being transported through nip 94 in the direction of arrow 96. In accordance with the present invention, the intermediate member 80 is provided in the form of an endless belt, having a path of transport defined by a plurality of transport rollers in contact with the inner surface thereof. It will be understood from the foregoing discussion of the developed image on the intermediate transfer member 80 is subsequently transferred to a copy substrate 100 by any suitable technique conventionally used in electrophotography, such as corona transfer, pressure transfer, bias roll transfer, and the like. In addition, transfer methods such as adhesive transfer, or differential surface energy transfer, wherein the receiving substrate has a higher surface energy with respect to the developing material making up the image, can also be employed. The features of the intermediate transfer belt 80, and the transport thereof will be discussed in greater detail following the instant discussion of the electrostatographic imaging process.

After the developed image is transferred to intermediate member 80, residual developer material may remain on the photoconductive surface of belt 18. A cleaning station 60 is therefore provided, which may include a roller 62, formed of any appropriate synthetic resin. It will be understood, that a number of photoconductor cleaning devices exist in the art, any of which would be suitable for use with the present invention. In addition, any residual charge left on the photoconductive surface may be extinguished by flooding the photoconductive surface with light from a lamp (not shown), in preparation for a subsequent successive imaging cycle so that successive electrostatic latent images may be developed and transferred to produce additional copies and/or prints.

The foregoing discussion provides a general description of the operation of a liquid developing material based electrostatographic printing machine incorporating an intermediate transfer member. It will be understood that the specific intermediate transfer member of the present invention may be utilized in a multicolor electrophotographic printing machine or, in a monocolor printing machine. Multicolor printing machines may use an intermediate transfer member where successive latent images are developed on the photoreceptor in superimposed registration to form a composite multicolor image which is subsequently transferred to the intermediate or where single color liquid images are successively transferred onto the intermediate in superimposed registration with one another for creating the multilayer image thereon.

Moving now to the specific details of the features of the present invention, the intermediate transfer member 80 is shown in greater detail in FIG. 1, wherein the intermediate transfer member 80 is provided in the form of an elastic belt comprised of an elastic material that permits the belt to compress and expand in response to tensile and stress forces exerted thereagainst along the path of travel thereof. In a preferred structure of the intermediate transfer belt 80 of the present invention, the belt comprises a multi-layer structure including an elastic or otherwise compliant support substrate layer having an elastic layer adjoined thereto for contacting and receiving the developed image. Suitable materials which may be used for the support substrate include urethane and polyurethane rubbers, ethylene propylene diene monomer rubber (EPDM) and like rubber materials. Suitable materials which may be used for the elastic coating layer may include elastic materials such as a polyurethane, silicone, fluorocarbon including fluoroelastomers, melamine and like rubber materials. One specific material which has been found to be particularly functional in the context of the present invention is VITON® rubber, available from E. I. DuPont de Numours and Co. It will be understood that various other materials which are also capable of being elastic may also be preferably used as the elastic layer. It will be understood that the materials used in the elastic belt member of the present invention should be selected with the properties of the intermediate transfer member 80 and the developing material, particularly any type of carrier liquid employed in the liquid developing material taken into consideration.

As can be seen from FIG. 2, the intermediate transfer belt 80 is transported in the direction of arrow 82, along a curvilinear path defined by a plurality of rollers 112, 114 and 116 for advancing a developed image transferred thereto from the photoreceptive member 18 to the copy substrate 100. As such, the belt 80 provides an apparatus for transporting a developed image from a moving image bearing member to a moving copy substrate. The belt is configured and adapted so as to receive the developed image from the moving photoreceptor 18 at a first nip formed between the moving photoreceptor 18 and the intermediate belt 80 and for subsequently transferring the developed image from the intermediate belt 80 to the moving copy substrate at a second nip formed between the intermediate member and the copy substrate.

The elastic nature of belt 80, as provided by the present invention, permits the belt 80 to be transported at different velocities along its path of travel, and more specifically with respect to the embodiment illustrated in FIG. 2, allows for the belt to be driven at two different speeds in the first and second nips as defined above. In particular, it has been found by the present invention that it can be advantageous to transport the intermediate member at a first velocity VI substantially equivalent to the velocity $V_{P/R}$ of the photoreceptor 18 as the intermediate is advanced toward, and in contact with, the photoreceptor at the nip formed therebetween, while transporting the intermediate member at a second velocity $V_I$ substantially different from the velocity $V_{P/R}$ of the photoreceptor 18 as the intermediate is advanced toward, and in contact with, the copy substrate at the nip formed therebetween. The first velocity can be greater than the second velocity such that the elastic belt is caused to compress along a path of travel thereof as the intermediate member exits the first nip and travels toward the second nip, or the second velocity can be greater than the first velocity such that the elastic belt is caused to stretch along a path of travel thereof as the intermediate member exits the first nip. Similarly, the different velocities can cause the elastic belt to expand or stretch along a path of travel thereof as the intermediate member exits the second nip, or the elastic belt can be caused to compress along a path of travel thereof as the intermediate member exits the second nip.

It will be understood that the use of differential velocities as contemplated by the present invention can be implemented by various means. For example, the rollers 112 and 116 adjacent each nip may simply be driven by two separate motors M1 and M2, with each motor adapted to provide the desired velocity to the intermediate transfer member. Alternatively, a single motor could be coupled to each roller, with each roller being provided with particular slip characteristics or coupled to a slip clutch apparatus for providing the desired differential velocities to the intermediate transfer belt. In another embodiment, a retard roll system 120 may be positioned along the path of travel of the intermediate in order to inhibit the transport motion of the intermediate to induce differential velocities.

It will be understood that the concept of providing differential velocities between a first transfer nip formed at the interface between the photoreceptor and the intermediate transfer member, and a second transfer nip formed at the interface between the intermediate transfer member and the copy substrate. yields various benefits. For example, the velocity of the intermediate may be controlled in response to a seam detector system for providing position control of the intermediate belt seam so as to force the seam of the belt to be positioned in a region in which image information is not present. In addition, differential velocities can provide improved copy substrate stripping by inducing the copy sheet to be separated from the intermediate belt. The concept of the present invention may also yield further advantage, including: the use of a broader range of copy substrates; isolation of motion quality noise; greater resiliency with respect to handling and environmental conditions; and permitting the use of thinner copy substrates having a relatively low dielectric thickness and thermal mass.

In review, an elastic intermediate transfer member and system for use thereof in an electrostatographic printing machine has been disclosed. The present invention includes an elastic intermediate transfer belt adapted to receive a developed image from an image bearing member at a first nip and further adapted to transfer the developed image from the intermediate member to a copy substrate at a second nip. The elastic nature of the belt permits the belt to be driven at differential velocities across the path of travel thereof such that the image bearing member and the moving intermediate member can be transported at a first velocity in the first nip while the intermediate transfer belt can be transported at a second velocity, substantially different from the first velocity in the second nip, wherein the elastic belt may be caused to stretch or compress along a path of travel thereof.

It is, therefore, apparent that there has been provided, in accordance with the present invention, an elastic intermediate belt and system for use in electrostatographic printing systems that fully satisfies the aspects of the invention hereinbefore set forth. It will be understood that, while this invention has been described in conjunction with specific embodiments thereof, many alternatives, modifications, and variations will be apparent to those skilled in the art. Accordingly, the present invention is intended to embrace all such alternatives, modifications and variations as falls within the spirit and broad scope of the appended claims.

We claim:

1. A printing system including an apparatus for transporting a developed image from a moving image bearing member to a moving copy substrate, comprising:

a moving intermediate member including an elastic belt adapted to receive the developed image from the moving image bearing member at a first nip formed between said moving image bearing member and said moving intermediate member, and further adapted to transfer the developed image from said moving intermediate member to said moving copy substrate at a second nip formed between said moving intermediate member and said moving copy substrate, said moving image bearing member and said moving intermediate member transported at a substantially equivalent first velocity in the first nip, and said moving intermediate member and said copy substrate transported at a substantially equivalent second velocity, substantially different from the first velocity, in the second nip.

2. The printing system of claim 1, wherein said elastic belt includes a material selected from the group consisting of urethane, polyurethane, ethylene propylene diene monomer, silicone, fluorocarbon, melamine, and VITON® rubber.

3. The printing system of claim 1, wherein the first velocity is greater than the second velocity.

4. The printing system of claim 3, wherein the elastic belt is caused to compress along a path of travel thereof as said intermediate member exits the first nip.

5. The printing system of claim 3, wherein the elastic belt is caused to expand along a path of travel thereof as said intermediate member exits the second nip.

6. The printing system of claim 1, wherein the second velocity is greater than the first velocity.

7. The printing system of claim 6, wherein the elastic belt is caused to stretch along a path of travel thereof as said intermediate member exits the first nip.

8. The printing system of claim 6, wherein the elastic belt is caused to compress along a path of travel thereof as said intermediate member exits the second nip.

9. A method for transporting a developed image from a moving image bearing member to a moving copy substrate, comprising the steps of:

transferring the developed image from the moving image bearing member to a moving intermediate transfer member at a first nip formed between said moving image bearing member and said moving intermediate member, said intermediate member including an elastic belt;

transferring the developed image from the moving intermediate transfer member to the copy substrate at a second nip formed between said moving intermediate member and said moving copy substrate, wherein;

said moving image bearing member and said moving intermediate member are transported at a substantially equivalent first velocity in the first nip; and said intermediate member and said moving copy substrate are transported at a substantially equivalent second velocity, different from the first velocity, in the second nip.

10. The method of claim 9, further including the step of causing the elastic belt to compress along a path of travel thereof as said intermediate member exits the first nip.

11. The method of claim 9, further including the step of causing the elastic belt to expand along a path of travel thereof as said intermediate member exits the second nip.

12. The method of claim 9, further including the step of causing the elastic belt to stretch along a path of travel thereof as said intermediate member exits the first nip.

13. The printing system of claim 9, wherein the elastic belt is caused to compress along a path of travel thereof as said intermediate member exits the second nip.

14. An apparatus for transporting a layer of material from a first moving member to a second moving member, comprising:

a moving intermediate member including an elastic belt adapted to receive the layer of material from the first moving member at a first nip formed between the first moving member and said moving intermediate member, said first moving member and said moving intermediate member moving at substantially equivalent first velocity in the first nip and further adapted to transfer the layer of material from said moving intermediate member to the second moving member at a second nip formed between said moving intermediate member and the second moving member, said second moving member and said intermediate moving member moving at a substantially equivalent second velocity in the second nip, said second velocity different from said first velocity.

* * * * *